US011108193B2

(12) United States Patent
Kanemura et al.

(10) Patent No.: US 11,108,193 B2
(45) Date of Patent: Aug. 31, 2021

(54) CONNECTOR AND CONNECTOR DEVICE

(71) Applicant: Sumitomo Wiring Systems, Ltd., Mie (JP)

(72) Inventors: Keisuke Kanemura, Yokkaichi (JP); Shohei Mitsui, Yokkaichi (JP)

(73) Assignee: Sumitomo Wiring Systems, Ltd.

( * ) Notice: Subject to any disclaimer, the term of this patent is extended or adjusted under 35 U.S.C. 154(b) by 0 days.

(21) Appl. No.: 16/831,656

(22) Filed: Mar. 26, 2020

(65) Prior Publication Data

US 2020/0313353 A1 Oct. 1, 2020

(30) Foreign Application Priority Data

Mar. 27, 2019 (JP) ..... JP2019-059705

(51) Int. Cl.

| | |
|---|---|
| ***H01R 13/639*** | (2006.01) |
| ***H01R 13/42*** | (2006.01) |
| ***H01R 13/629*** | (2006.01) |
| ***H01R 13/11*** | (2006.01) |
| ***H01R 12/51*** | (2011.01) |
| ***H01R 13/502*** | (2006.01) |

(52) U.S. Cl.

CPC ..... *H01R 13/639* (2013.01); *H01R 12/51* (2013.01); *H01R 13/11* (2013.01); *H01R 13/42* (2013.01); *H01R 13/502* (2013.01); *H01R 13/629* (2013.01)

(58) Field of Classification Search

CPC ..... H01R 13/639; H01R 12/51; H01R 13/11; H01R 13/42; H01R 13/502

USPC ..... 439/345

See application file for complete search history.

(56) References Cited

U.S. PATENT DOCUMENTS

| | | | | |
|---|---|---|---|---|
| 7,326,081 | B2 * | 2/2008 | Singer | H01R 4/18 439/595 |
| 7,641,502 | B2 * | 1/2010 | Itou | H01R 13/533 439/383 |
| 8,939,799 | B2 * | 1/2015 | Watanabe | H01R 13/627 439/686 |
| 9,923,298 | B2 * | 3/2018 | Hashimoto | H01R 13/5025 |
| 10,305,221 | B2 * | 5/2019 | Ohfuku | H01R 13/641 |
| 10,734,762 | B2 * | 8/2020 | Kanemura | H01R 13/4362 |
| 10,756,485 | B2 * | 8/2020 | Ohfuku | H01R 13/6275 |
| 10,804,639 | B2 * | 10/2020 | Masuda | H01R 13/502 |

(Continued)

FOREIGN PATENT DOCUMENTS

JP 2018-014300 1/2018

*Primary Examiner* — Alexander Gilman

(74) *Attorney, Agent, or Firm* — Gerald E. Hespos; Michael J. Porco; Matthew T. Hespos

(57) ABSTRACT

A connector is connected to a mating connector and includes at least one terminal, a housing and a retainer (90). The housing includes at least one fitting (72) and an exposed portion (80). The fitting (72) is fit into the mating connector and formed with a terminal accommodating portion for accommodating the terminal. The exposed portion (80) is exposed from the mating connector. The retainer (90) includes a locked portion and a locking protrusion (94). The locked portion is assembled with the exposed portion (80) and locked to a locking portion provided on the exposed portion (80), thereby fixing the retainer (90) to the housing. The locking protrusion (94) is assembled with the fitting (72) to project into the terminal accommodating portion and retains the terminal in the terminal accommodating portion.

4 Claims, 16 Drawing Sheets

(56) References Cited

U.S. PATENT DOCUMENTS

| | | | | |
|---|---|---|---|---|
| 10,826,220 | B1 * | 11/2020 | Butcher | H01R 13/42 |
| 10,847,916 | B2 * | 11/2020 | Endo | H01R 13/4361 |
| 2008/0182448 | A1 * | 7/2008 | Glaser | H01R 13/6272<br>439/352 |
| 2009/0186524 | A1 * | 7/2009 | Maesoba | H01R 13/4364<br>439/595 |
| 2020/0106202 | A1 * | 4/2020 | Consoli | H01R 13/03 |

* cited by examiner

CONNECTOR AND CONNECTOR DEVICE

BACKGROUND

Field of the Invention

This disclosure relates to a connector and a connector device.

Related Art

Japanese Unexamined Patent Publication No. 2018-14300 discloses a connector that is connectable to a mating connector. This connector includes a female terminal and a female housing. The female housing includes a fitting portion to be fit into a fitting recess of the mating connector. The fitting portion includes a terminal accommodation chamber for accommodating the female terminal and a retainer for locking the female terminal in the terminal accommodation chamber.

The retainer includes two side plates and a locking block between the side plates. The side plates include locks that are lockable to full locking projections on outer side walls of the terminal accommodation chamber. The retainer is mounted in the terminal accommodation chamber by locking the locking portions and the full locking projections. The locking block of the retainer that is mounted into the terminal accommodation chamber is behind the female terminal in the terminal accommodation chamber to retain the female terminal in the terminal accommodation chamber.

Locking margins of the full locking projections and the locking portions need to be secured in the connector to mount the retainer in the terminal accommodation chamber. However, if the locking margins of the full locking projections and the locking portions are secured, the fitting portion becomes larger in a width direction, with the result that the mating connector is enlarged.

The connector of this specification reduces the size of a fitting portion.

SUMMARY

This disclosure is directed to a connector to be connected to a mating connector. The connector includes at least one terminal, a housing and a retainer. The housing includes at least one fitting and an exposed portion. The fitting is fit into the mating connector and is formed with a terminal accommodating portion for accommodating the terminal. The exposed portion is exposed from the mating connector when the fitting is fit into the mating connector. The retainer includes a locked portion and a locking protrusion. The locked portion is assembled with the exposed portion and is locked to a lock on the exposed portion, thereby fixing the retainer to the housing. The locking protrusion is assembled with the fitting to project into the terminal accommodating portion and retains the terminal in the terminal accommodating portion when the retainer is fixed to the housing.

The locked portion for fixing the retainer to the housing is arranged around the exposed portion deviated from a part to be fit to the mating connector. That is, since the locked portion need not be assembled with the fitting, the terminal can be retained in the terminal accommodating portion by the retainer while the fitting is reduced in size.

A connector device includes at least one connector and the mating connector. The mating connector includes a mating housing includes an accommodating portion into which the fitting is fit. The accommodating portion has walls that surround the fitting, and the locked portion is aligned in a connecting direction with one of the walls when the fitting and the accommodating portion are fit.

When the fitting and the accommodating portion are fit, the locked portion is arranged in a part that originally is a dead space formed in the connecting direction in the wall. That is, since the locked portion is arranged in the part that is originally a dead space, the enlargement of the connector device can be suppressed while the fitting is reduced in size.

Plural connectors may be provided, and plural cavities may be provided for receiving a corresponding number of the fittings. Separation walls may partition between adjacent fittings. The locked portions of the housings that are adjacent in a lateral direction may be aligned in the connecting direction with the separation wall. In the case of fitting the fittings into the accommodating portion, a distance between the fittings increases and the fittings are enlarged. However, according to this disclosure, the locked portions need not be assembled with the fittings, and the fittings can be smaller. In this way, the distance between the fittings can be reduced and the connector device can be smaller. Further, when the fittings are fit respectively into the cavities, the adjacent locked portions are in the part of the separation wall that originally is a dead space formed in the connecting direction. Thus, the connector device is smaller and less complex as compared to the case where the locked portions are at different positions.

The fitting may be formed with a projecting posture restricting portion extending in the connector device. The separation wall is formed with concave receiving portions for respectively accommodating the posture restricting portions of the adjacent fittings, and the receiving portions in the separation wall are deviated in a direction intersecting the connecting direction. The receiving portions and the posture restricting portions are locked in the direction intersecting the connecting direction. Thus, posture inclination of the fittings in the intersecting direction can be restricted.

The receiving portions for accommodating the posture restricting portions are concave and are deviated in the direction intersecting the connecting direction in the separation wall. In this way, the distance between the fittings can be reduced, for example, as compared to the case where the receiving portions in the separation wall are arranged side by side in the lateral direction or are formed to project. That is, the connector device can be reduced in size.

According to the present disclosure, it is possible to reduce the size of a fitting portion.

DETAILED DESCRIPTION

One embodiment of the disclosure is described with reference to FIGS. 1 to 16.

[Connector Device 10]

Figure 1:
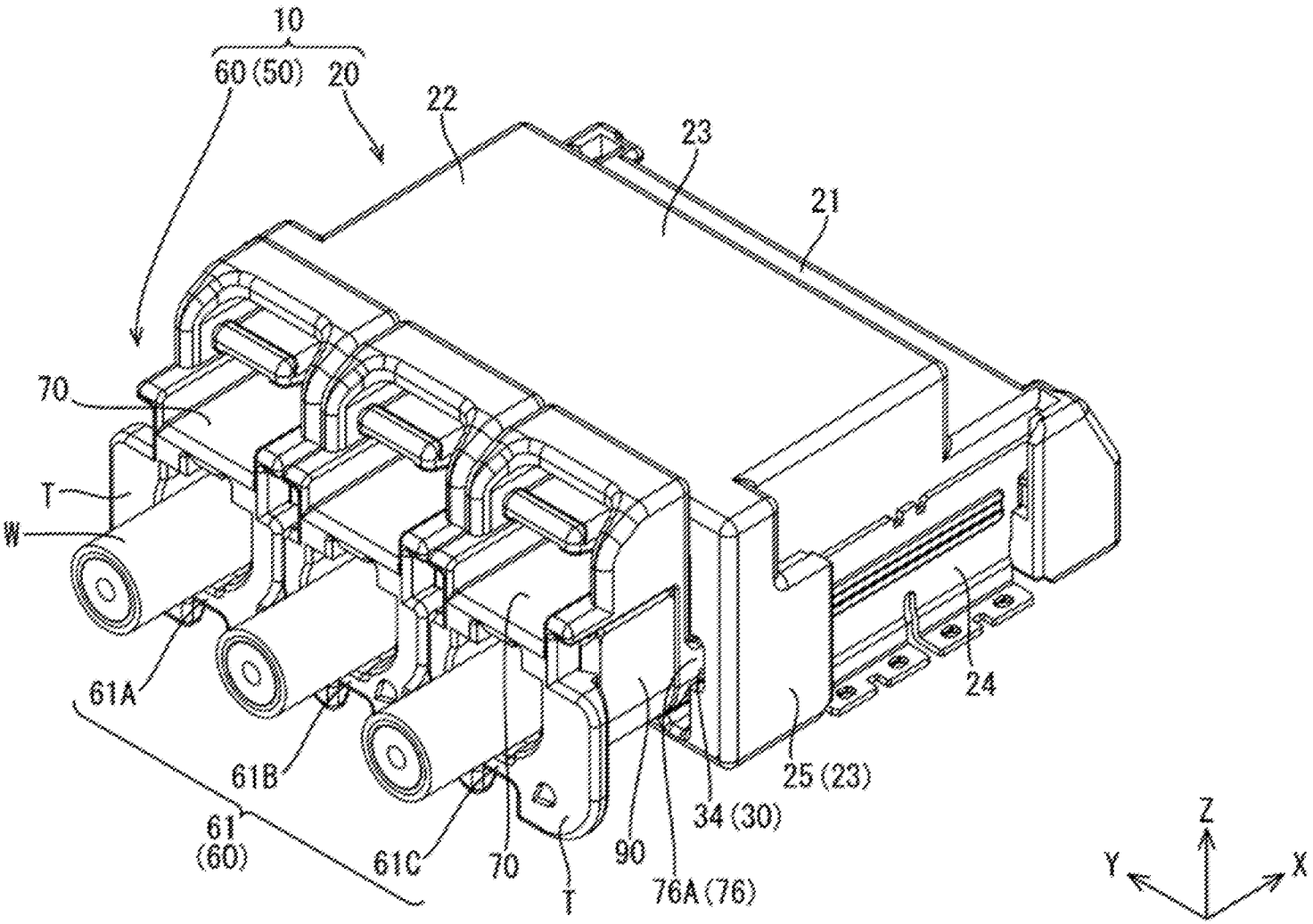
FIG. 1 is a perspective view showing a state where a wire-side connector set and a board connector according to an embodiment are connected.
Figure 2:
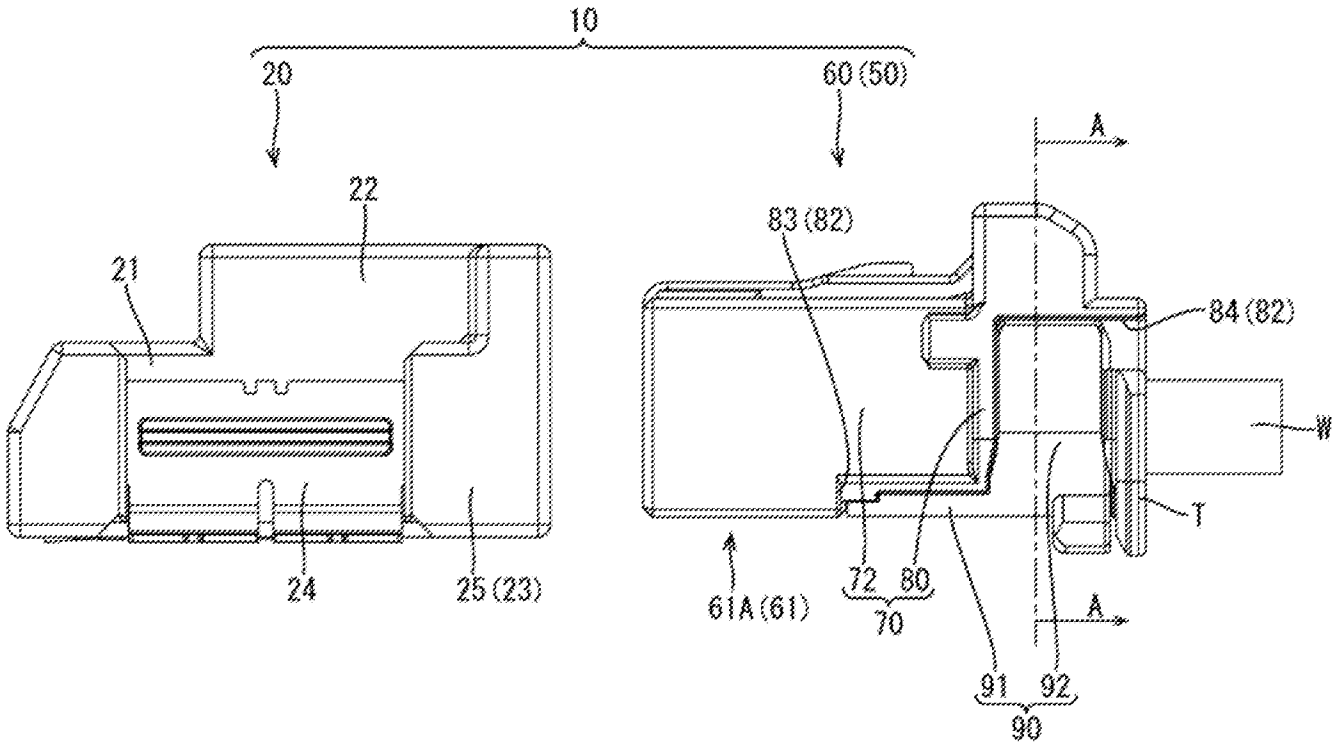
FIG. 2 is a side view showing a state before the wire-side connector set and the board connector are connected.

A connector device 10 of this embodiment includes a board connector (an example of a "mating connector") 20 to be fixed to an unillustrated circuit board and a connector group 50 to be connected to end parts of shielded cables W, as shown in FIGS. 1 and 2.

In the following description, a front-rear direction is based on an X direction in FIG. 1, a direction of connecting the board connector 20 and the connector group 50 to each other is referred to as a forward direction, a direction indicated by an arrow Z is referred to as an upward direction and a direction indicated by an arrow Y is referred to as a leftward direction. Further, some identical members may be denoted by a reference sign and the other members may not be denoted by the reference sign.

[Board Connector 20]

Figure 3:
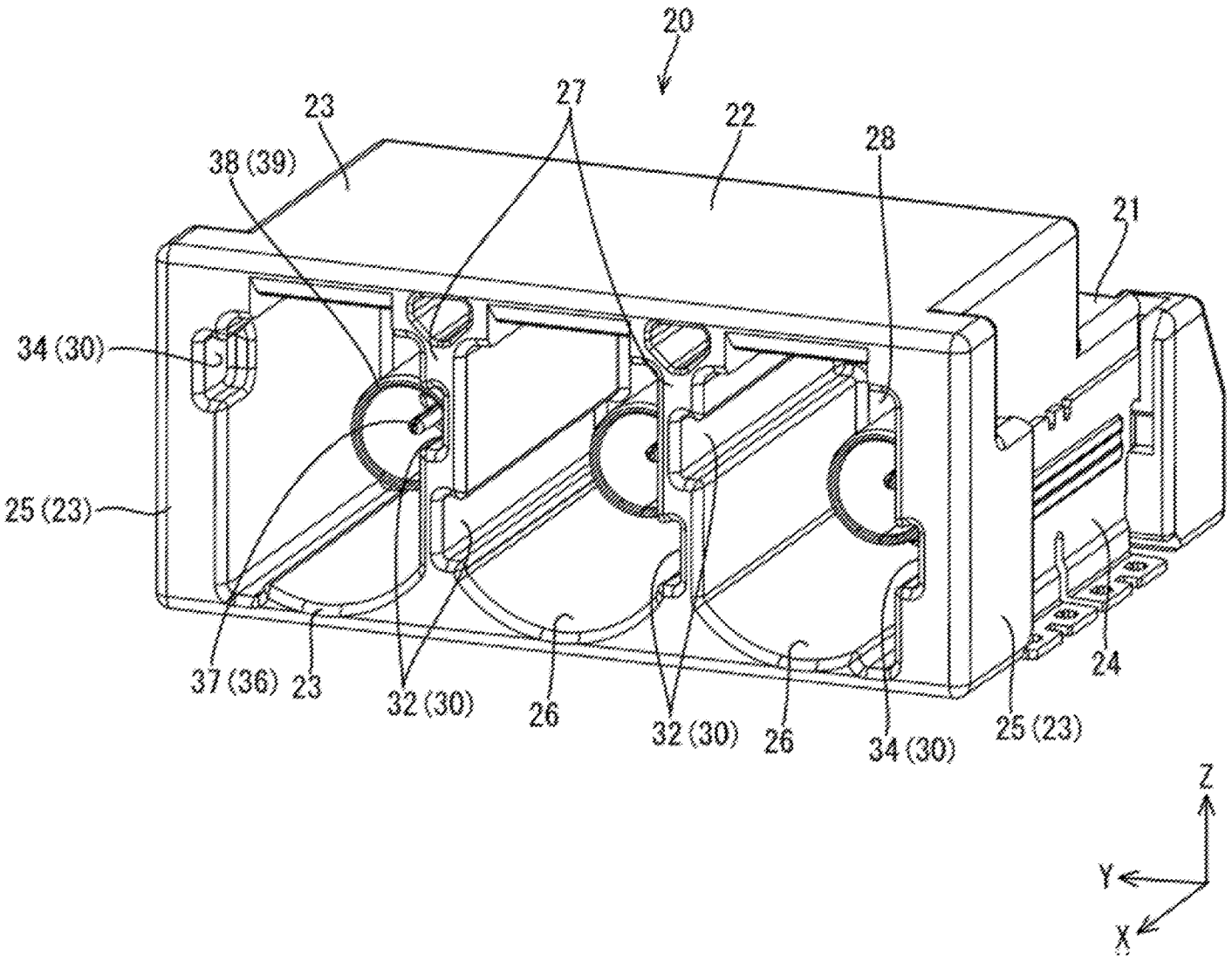
FIG. 3 is a perspective view of the board connector.

As shown in FIG. 3, the board connector 20 includes board-side inner conductors 36, board-side outer conductors 38 and a board housing (an example of a "mating housing") 21.

[Board Housing 21]

The board housing 21 is made of synthetic resin. The board housing includes an accommodating portion 22 and mounting portions 24.

As shown in FIG. 3, the accommodating portion 22 has a wide rectangular shape with walls 23 arranged on upper, lower, left and right sides. The wall portions 23 on both lateral sides are side walls 25 and has the mounting portions 24 fixed thereto.

The mounting portion 24 is formed by working a metal plate by a press or the like and has a lower end part soldered to the circuit board to fix the board housing 21 to the circuit board.

Figure 4:
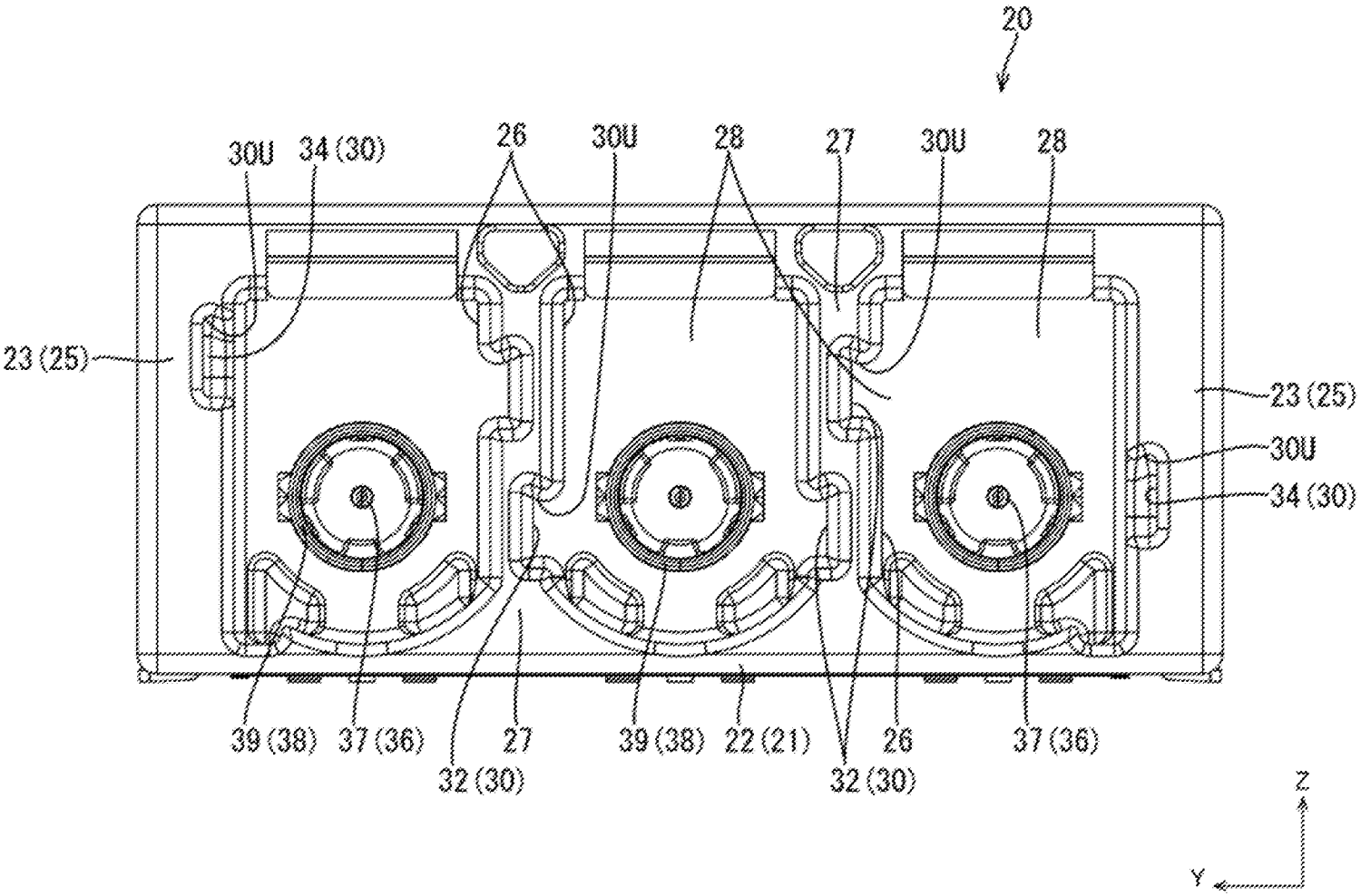
FIG. 4 is a front view of the board connector.

As shown in FIGS. 3 and 4, this particular embodiment has three forwardly open cavities 26 formed side by side in a row in the lateral direction inside the accommodating portion 22, and separation walls 27 are formed between adjacent cavities 26. As shown in FIGS. 3 and 4, the separation walls 27 extend in a front-rear direction from a front end of the accommodating portion 22 to a back wall 28. Further, the separation walls 27 extend vertically to connect to the upper wall 23 and the lower wall 23 of the accommodating portion 22.

Receiving portions 30 are formed in the side walls 25 and the separation walls 27 of the accommodating portion 22 and are recessed concavely in the lateral direction from the inner surfaces of the cavities 26, as shown in FIGS. 3 and 4.

The receiving portions 30 of the separation walls 27 are long receiving portions 32 extending in the front-rear direction from the front of the accommodating portion 22 to the back wall 28. The long receiving portions 32 have a lateral depth that is about half the thickness of the separation wall 27. An upper inner surface of the long receiving portion 32 forms an inclined surface 30U inclined up along a recess direction of the long receiving portion 32.

The long receiving portion 32 of the separation wall 27 that is arranged on the side of the central cavity 26 is in a lower part of the separation wall 27. The long receiving portions 32 of the separation wall 27 that arranged on the side of the outer cavity 26 is arranged in an upper part of the separation wall 27. Thus, each separation wall 27 is formed with two long receiving portions 32 deviated in the vertical direction.

The receiving portion 30 in the side wall 25 is a short receiving portion 34 extending a short distance in the front-rear direction from the front of the accommodating portion 22. The short receiving portion 34 is deviated in the vertical direction from the long receiving portions 32 of the separation wall 27 facing the side wall 25 in the lateral direction. A lateral depth of the short receiving portion 34 is equal to the depth of the long receiving portion 32. An inclined surface 30U is formed along the top of the short receiving portion 34 and is inclined upward along a recess direction of the short receiving portion 34.

[Board-Side Inner Conductors 36]

The board-side inner conductor 36 is formed by working a conductive metal plate. As shown in FIG. 3, the board-side inner conductor 36 includes a pin-like male connecting portion 37 extending in the front-rear direction.

[Board-Side Outer Conductors 38]

The board-side outer conductor 38 is formed by working a conductive metal plate. The board-side outer conductor 38 includes a hollow cylindrical board-side tube 39 surrounding the male connecting portion 37. The board-side tube 39 is held through the back wall 28 of the board housing 21 in the front-rear direction.

[Connector Group 50]

The connector group 50 includes a wire-side connector set 60 having plural connectors 61, as shown in FIGS. 5 to 11, and a multi-pole wire-side connector 100, as shown in FIGS. 12 to 16. Either one of the wire-side connector set 60 and the multi-pole wire-side connector 100 is selected according to use and is connected to the board connector 20.

Specifically, for example, if the shielded cables W are routed at different timings or routed along different paths, it is difficult to gather the shielded cables W into one and connect the shielded cables W to the board connector 20. In such a case, the wire-side connector set 60 enables the connectors 61 to be mounted individually on the respective shielded cables W and connected to the board connector 20. Thus, if the shielded cables W are routed at different timings or routed along different paths, connection work for connecting the respective shielded cables W to the board connector 20 can be improved by selecting the wire-side connector set 60.

On the other hand, the multi-pole wire-side connector 100 is selected when simultaneously connecting the shielded cables W to the board connector 20, such as when the shielded cables W have a common routing path. That is, connection work can be improved since the shielded cables W can be connected collectively to the board connector 20 by selecting the multi-pole wire-side connector 100.

Specifically, according to this embodiment, the board connector 20 to be connected to the circuit board is provided in common to the wire-side connector set 60 and the multi-pole wire-side connector 100. Either one of the wire-side connector set 60 and the multi-pole wire-side connector 100 is selected according to a routed state of the shielded cables W.

That is, on the circuit board side, even if the specifications of the shielded cables W are changed, one board connector 20 can deal with such a case. On the other hand, the wire-side connector set 60 or multi-pole wire-side connector 100 on the side of the shielded cables W can be selected according to the connection workability of the shielded cables W.

The wire-side connector set 60 is described below with reference to FIGS. 5 to 11.

[Wire-Side Connector Set 60]

Figure 5:
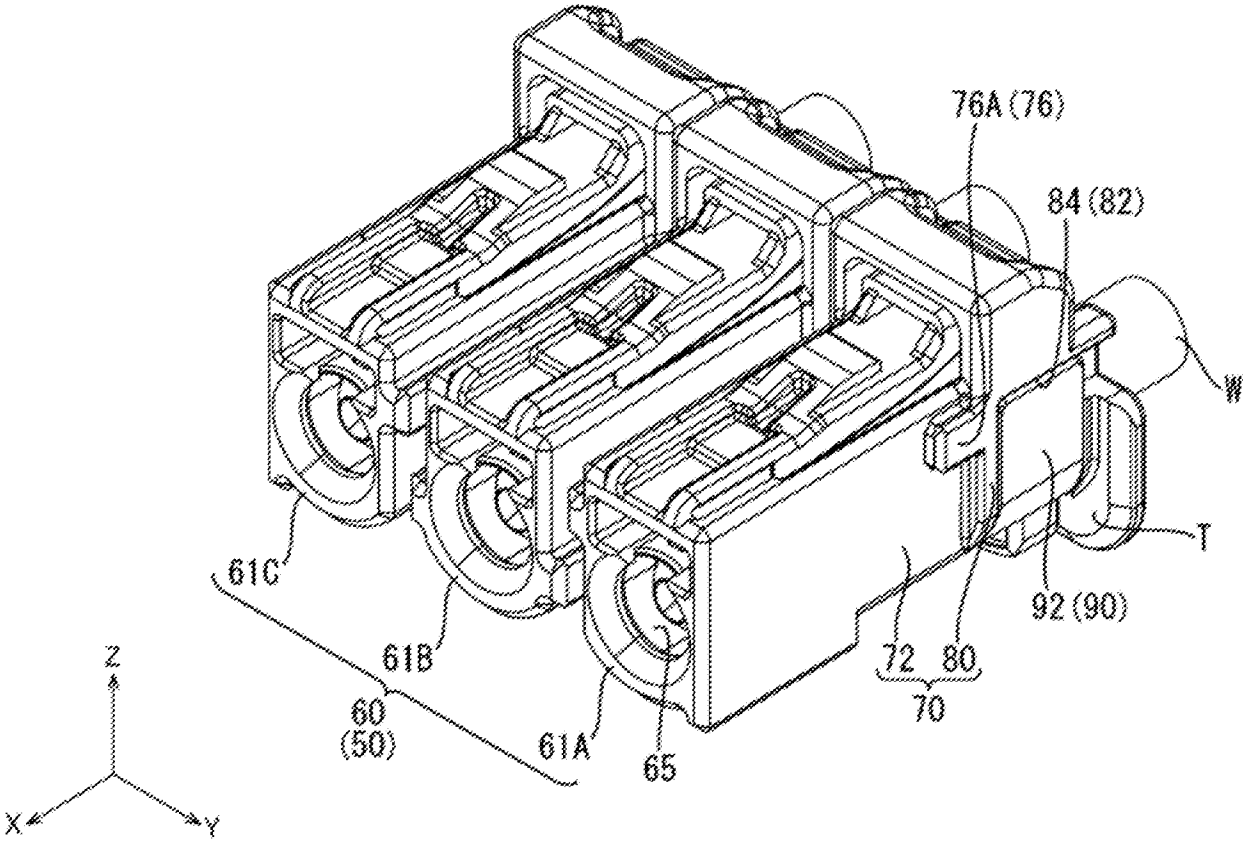
FIG. 5 is a perspective view of the wire-side connector set.

As shown in FIG. 5, the wire-side connector set 60 includes the connectors 61 to be connected respectively to the ends of the shielded cables W. The wire-side connector set 60 in this embodiment includes three connectors 61, namely, a first connector 61A, a second connector 61B and a third connector 61C from the left, as shown in FIG. 5. The first, second and third connectors 61A, 61B and 61C are fit respectively into the cavities 26 of the accommodating portion 22 while being arranged in the lateral direction, as shown in FIG. 1.

Figure 6:
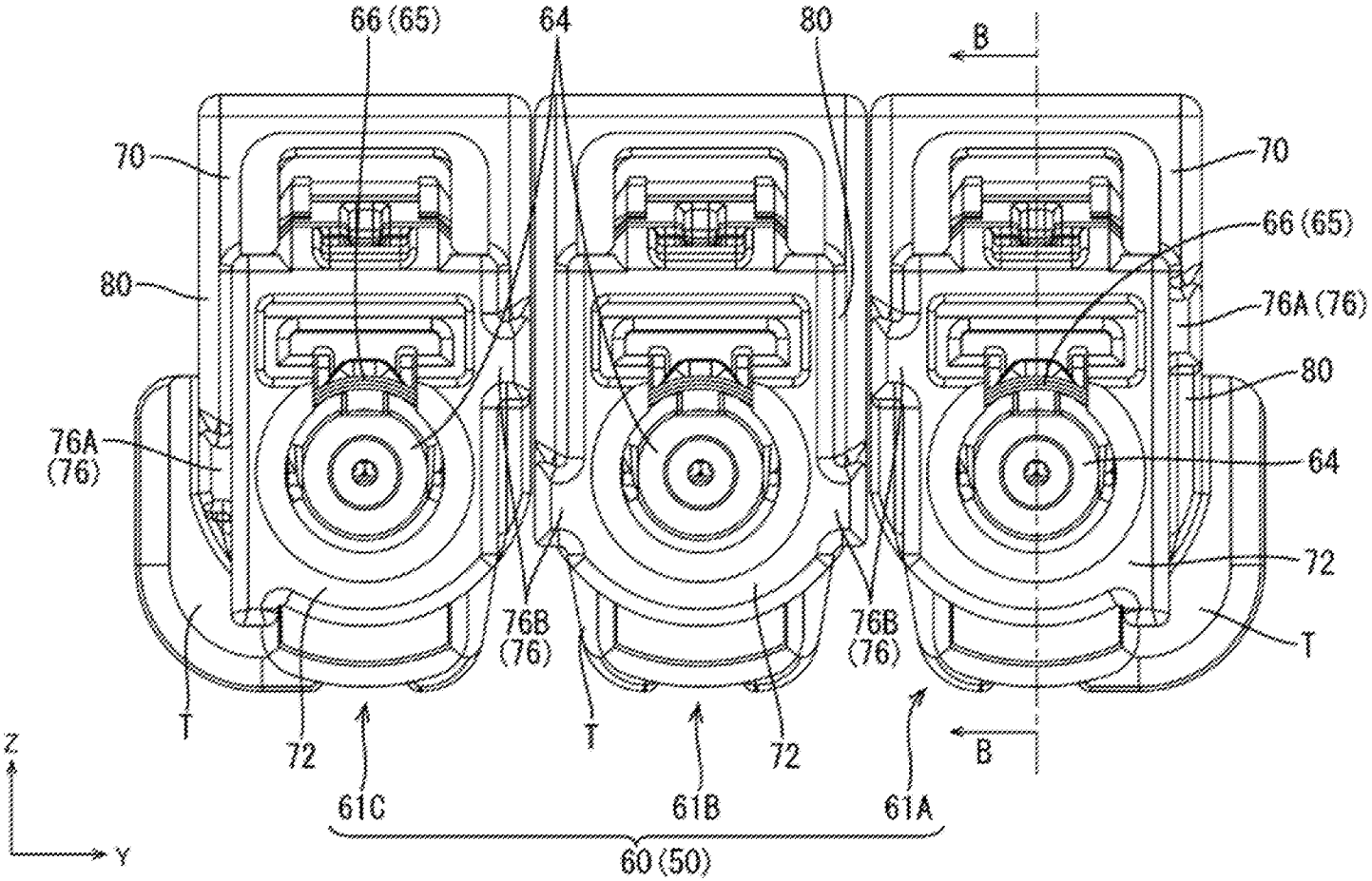
FIG. 6 is a front view of the wire-side connector set.

As shown in FIG. 6, the first, second and third connectors 61A, 61B and 61C differ in the shape of a finger placing portion T provided on the outer surface of a rear lower part and the position of a posture restricting portion 76 to be described later, but have a common configuration other than the finger placing portion T and the posture restricting portion 76.

As shown in FIG. 6, the finger placing portion T of the first connector 61A protrudes farther left than the finger placing portion T of the second connector 61B, and the finger placing portion T of the third connector 61C protrudes farther right than the finger placing portion T of the second connector 61B.

The configuration common to all three connectors 61A, 61B and 61C is described, using the first connector 61A as a representative. Repeated description for the second and third connectors 61B, 61C is omitted, and components common to those of the first connector 61A are denoted by the same reference signs in the second and third connectors 61B, 61C.

[First Connector 61A]

Figure 7:
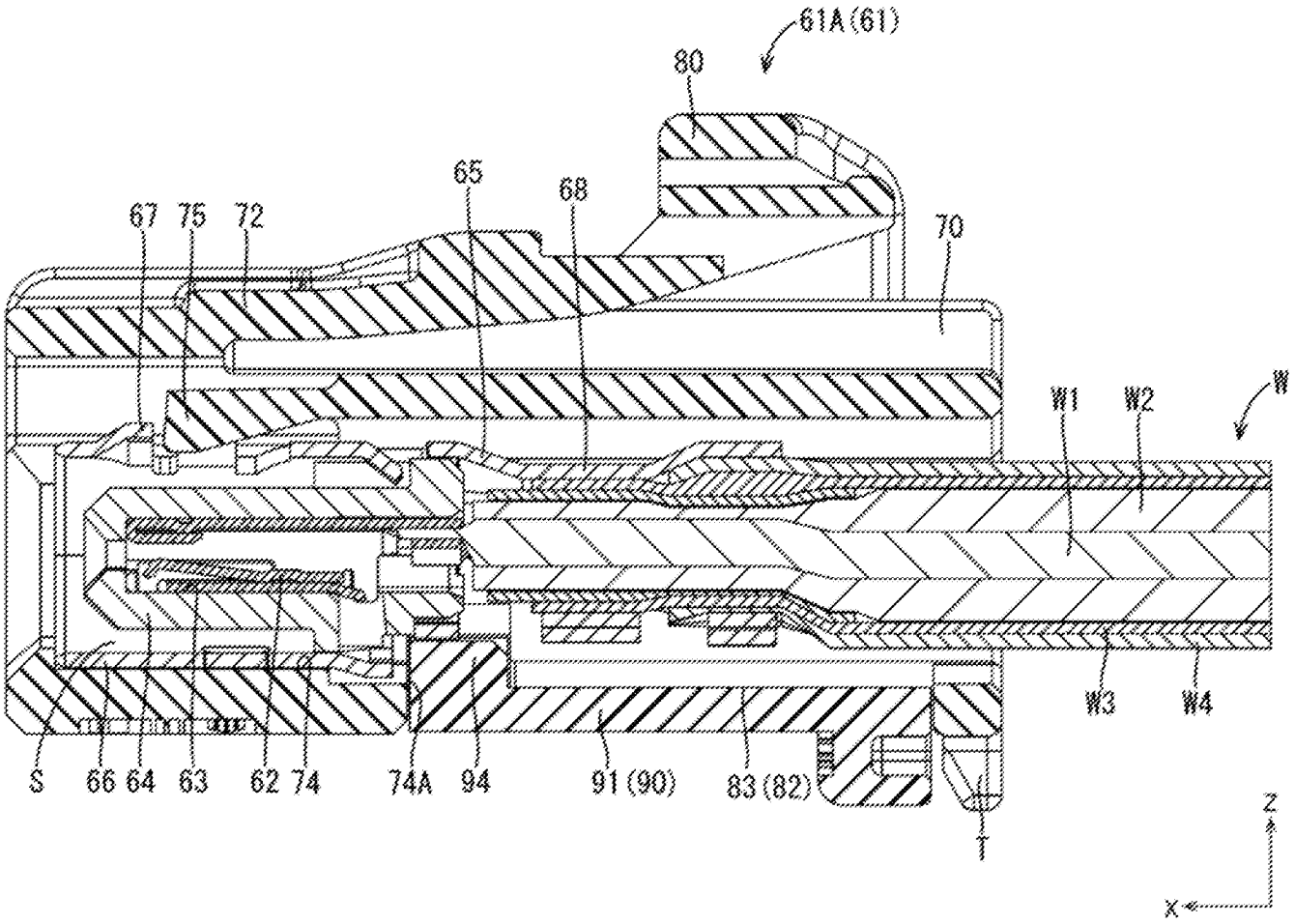
FIG. 7 is a section along B-B of FIG. 6.

As shown in FIG. 7, the first connector 61A includes a wire-side inner conductor 62 and a wire-side outer conductor (an example of a "terminal") 65 to be connected to the end of the shielded cable W. A dielectric 64 is arranged between the wire-side inner conductor 62 and the wire-side outer conductor 65. A wire-side housing (an example of a "housing") 70 accommodates the wire-side outer conductor 65 and a retainer 90 is assembled with the wire-side housing 70.

[Shielded Cable W]

As shown in FIG. 7, the shielded cable W includes a core W1, an insulating inner coating W2 covering the outer periphery of the core W1, a braided wire W3 covering the outer periphery of the inner coating W2 and an outer coating W4 covering the outer periphery of the braided wire W3.

The core W1 is exposed by stripping the inner coating W2, the braided wire W3 and the outer coating W4 in a front part of the shielded cable W, and only the outer coating W4 is stripped behind the exposed core W1 to expose the braided wire W3.

[Wire-Side Inner Conductor 62]

As shown in FIG. 7, the wire-side inner conductor 62 is made of conductive metal and is formed as a female terminal. The wire-side inner conductor 62 is crimped and electrically connected to the core W1 exposed in the shielded cable W.

[Dielectric 64]

The dielectric 64 is made of insulating synthetic resin and is formed into a hollow cylindrical shape. An inner conductor accommodating portion 63 for accommodating the wire-side inner conductor 62 penetrates through the dielectric 64 in the front-rear direction.

[Wire-Side Outer Conductor 65]

The wire-side outer conductor 65 is formed by working a conductive metal plate. As shown in FIG. 7, the wire-side outer conductor 65 includes a hollow cylindrical connecting tube 66 and a crimping portion 68 connected behind the connecting tube 66.

A projection 67 projects up on the top of the connecting tube 66. The dielectric 64 can be accommodated in the connecting tube 66 with a clearance S therebetween. The board-side outer conductor 38 enters the clearance S between the connecting tube 66 and the dielectric 64 when the board connector 20 and the connector 61 are connected. The board-side outer conductor 38 that enters the clearance S and the connecting tube 66 contact each other to connect the board-side outer conductor 38 and the wire-side outer conductor 65 electrically.

The crimping portion 68 is crimped to the outer periphery of the braided wire W3 of the shielded cable W so that the wire-side outer conductor 65 and the braided wire W3 are connected electrically.

[Wire-Side Housing 70]

The wire-side housing 70 is made of insulating synthetic resin and, as shown in FIG. 5, includes a rectangular tubular fitting 72 that is long in the front-rear direction. An exposed portion 80 is connected to the rear end of the fitting 72.

[Fitting 72]

As shown in FIG. 1, the fitting 72 is fittable into the left cavity 26 of the accommodating portion 22 in the board connector 20 and is shaped to correspond to the left cavity 26.

As shown in FIG. 7, an outer conductor accommodating portion (an example of a "terminal accommodating portion") 74 is formed inside the fitting 72 and receives the wire-side outer conductor 65 from behind. A locking lance 75 project down toward the front in an upper part of the front end of the outer conductor accommodating portion 74 and is configured to be resiliently displaced in the vertical direction.

The locking lance 75 is behind the projection 67 of the wire-side outer conductor 65 when the wire-side outer conductor 65 is accommodated in the outer conductor accommodating portion 74. Thus, the wire-side outer conductor 65 is retained in the outer conductor accommodating portion 74 by the projection 67 and the locking lance 75 locking each other in the front-rear direction.

As shown in FIG. 6, the posture restricting portions 76 project out from both left and right sides of the fitting 72 and extend in the front-rear direction. The posture restricting portions 76 are substantially rectangular and are at positions corresponding to the receiving portions 30 in the side walls 25 and the separation walls 27 of the accommodating portion 22. The posture restricting portions 76 corresponding to the short restricting portions 34 of the side walls 25 serve as short restricting portions 76A, and the posture restricting portions 76 corresponding to the long receiving portions 32 of the separation walls 27 serve as long restricting portions 76B.

Each posture restricting portion 76 is fit into the corresponding receiving portion 30 in the process of fitting the fitting 72 into the cavity 26. The posture restricting portion 76 fit into the receiving portion 30 is locked to a vertical inner surface of the receiving portion 30 to restrict the vertical inclination of the fitting 72 in the cavity 26 when the shielded cable W pulled out from each connector 61 is shaken in the vertical direction.

As shown in FIG. 7, a mounting recess 82 is formed in a lower end part of the fitting 72 and is provided in common to the exposed portion 80.

Figure 8:
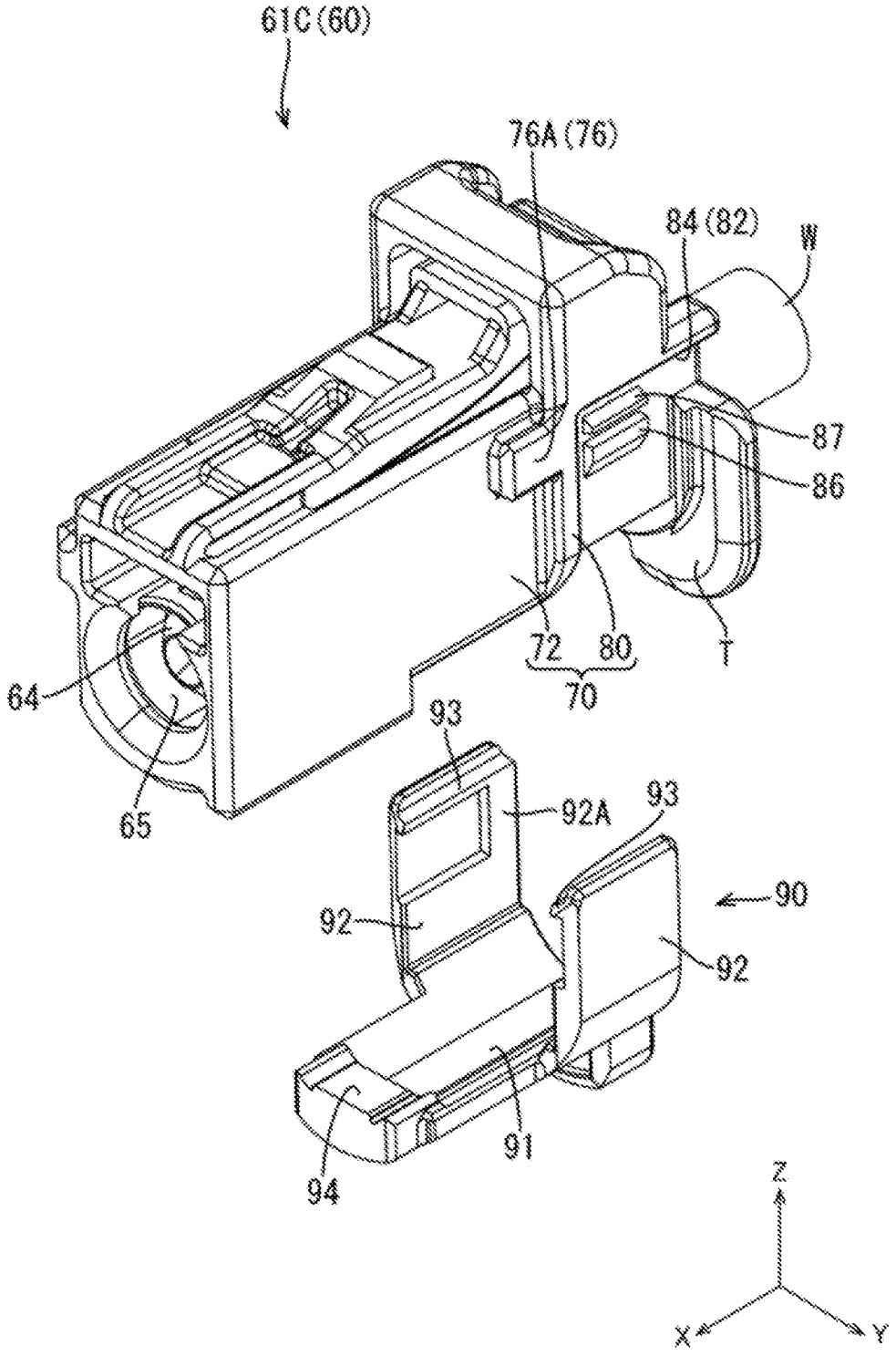
FIG. 8 is a perspective view showing a state before a retainer is mounted on a wire-side housing.
Figure 9:
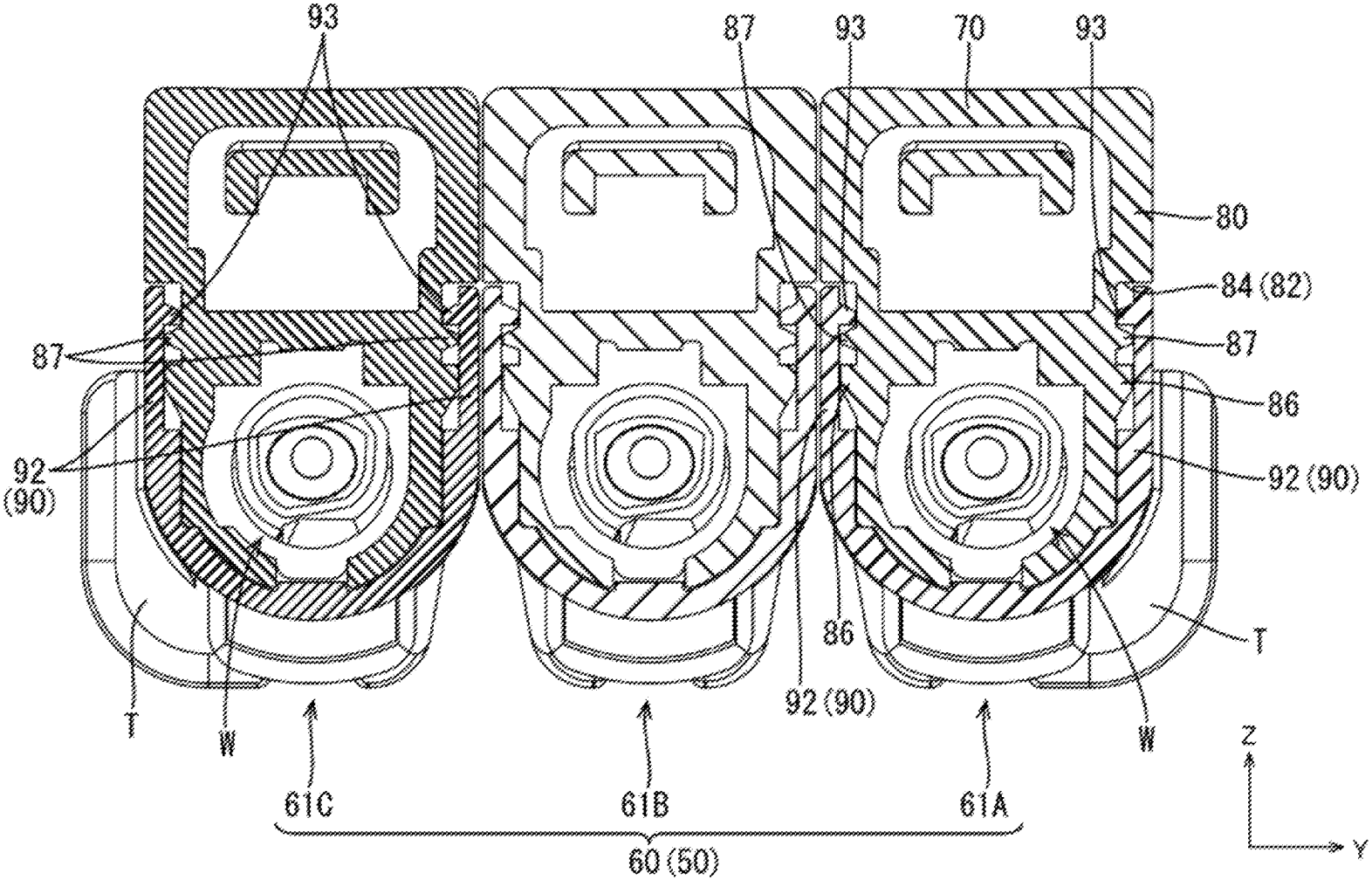
FIG. 9 is a section along A-A of FIG. 2.

The mounting recess 82 includes a first mounting recess 83 concavely formed over the lower end part of the fitting 72 and a lower end part of the exposed portion 80, as shown in FIG. 7, and second mounting recesses 84 concavely formed in both lateral side parts of the exposed portion 80, as shown in FIGS. 8 and 9.

As shown in FIG. 7, the first mounting recess 83 extends in the front-rear direction in the lower end parts of the fitting 72 and the exposed portion 80. A mounting hole 72A is formed in a front part of the first mounting recess 83 and communicates with the outer conductor accommodating portion 74 of the fitting 72.

[Exposed Portion 80]

As shown in FIG. 8, the exposed portion 80 is in the form of a rectangular tube that is wider than the fitting 72. The exposed portion 80 projects from the accommodating portion 22 to be exposed when the fitting 72 is fit into the cavity 26 as shown in FIG. 1.

The second mounting recesses 84 of the exposed portion 80 are continuous with the first mounting recess 83 in the lateral side parts of the exposed portion 80, as shown in FIG. 8. A partial locking portion 86 and a full locking portion (an example of a "locking portion") 87 project laterally on a lateral side surface of the second mounting recess 84 with the full locking portion 87 being above the partial locking portion 86.

[Retainer 90]

As shown in FIG. 8, the retainer 90 is made of insulating synthetic resin separately from the wire-side housing 70 and is mountable into the mounting recess 82 of the wire-side housing 70 from below. The retainer 90 includes a locking portion body 91 to be mounted into the first mounting recess 83 and two locked pieces (an example of a "locked portion") 92 to be mounted into the second mounting recesses 84.

The locked pieces 92 extend up from both lateral side edges of a rear end part of the locking portion body 91. Each locked piece 92 is resiliently displaceable in the lateral direction with a boundary part to the locking portion body 91 as a fulcrum. A locked projection 93 is formed on an upper part of each locked piece 92 and is lockable in the vertical direction by the partial locking portion 86 and the full locking portion 87 of the second mounting recess 84.

Each locked projection 93 extends in the front-rear direction on the upper edge of the locked piece 92 so as to be connected to a reinforcing portion 92A provided on the rear end of the locked piece 92 and extending in the vertical direction.

Each locked piece 92 can be displaced resiliently in the lateral direction so that the locked projection 93 can ride over the partial locking portion 86 and the full locking portion 87. The locked pieces 92 then resiliently return so that the locked projections 93 can lock to the partial locking portions 86 or the full locking portions 87 in the vertical direction. Thus, the locked projection 93 can be locked to the partial locking portion 86 to hold the retainer 90 at a partial locking position projecting down from the mounting recess 82. Further, the locked projection 93 can be locked to the full locking portion 87 above the full locking portion 87, as shown in FIG. 9, to hold the retainer 90 at a full locking position in the mounting recess 82.

As shown in FIGS. 7 and 8, the locking portion body 91 is long in the front-rear direction and is mountable into the first mounting recess 83 from below. A locking protrusion 94 projects up on a front part of the locking portion body 91. The locking protrusion 94 is a block having a corner in an upper part of a front surface.

The locking protrusion 94 is arranged outside the outer conductor accommodating portion 74 with the retainer 90 held at the partial locking position. If the retainer 90 is arranged at the full locking position to be mounted in the mounting recess 82, the locking protrusion 94 projects into the outer conductor accommodating portion 74 and is arranged behind the connecting tube 66 of the wire-side outer conductor 65 accommodated in the outer conductor accommodating portion 74, as shown in FIG. 7. That is, the wire-side outer conductor 65 is retained redundantly by the locking lance 75 and the retainer 90 in the outer conductor accommodating portion 74.

Further, if the retainer 90 is held at the full locking position in the mounting recess 82, the locking portion body 91 constitutes the outer surfaces of the lower parts of the fitting 72 and the exposed portion 80 and the two locked pieces 92 constitute the left and right outer side surfaces of the exposed portion 80, as shown in FIGS. 7 and 9.

Figure 10:
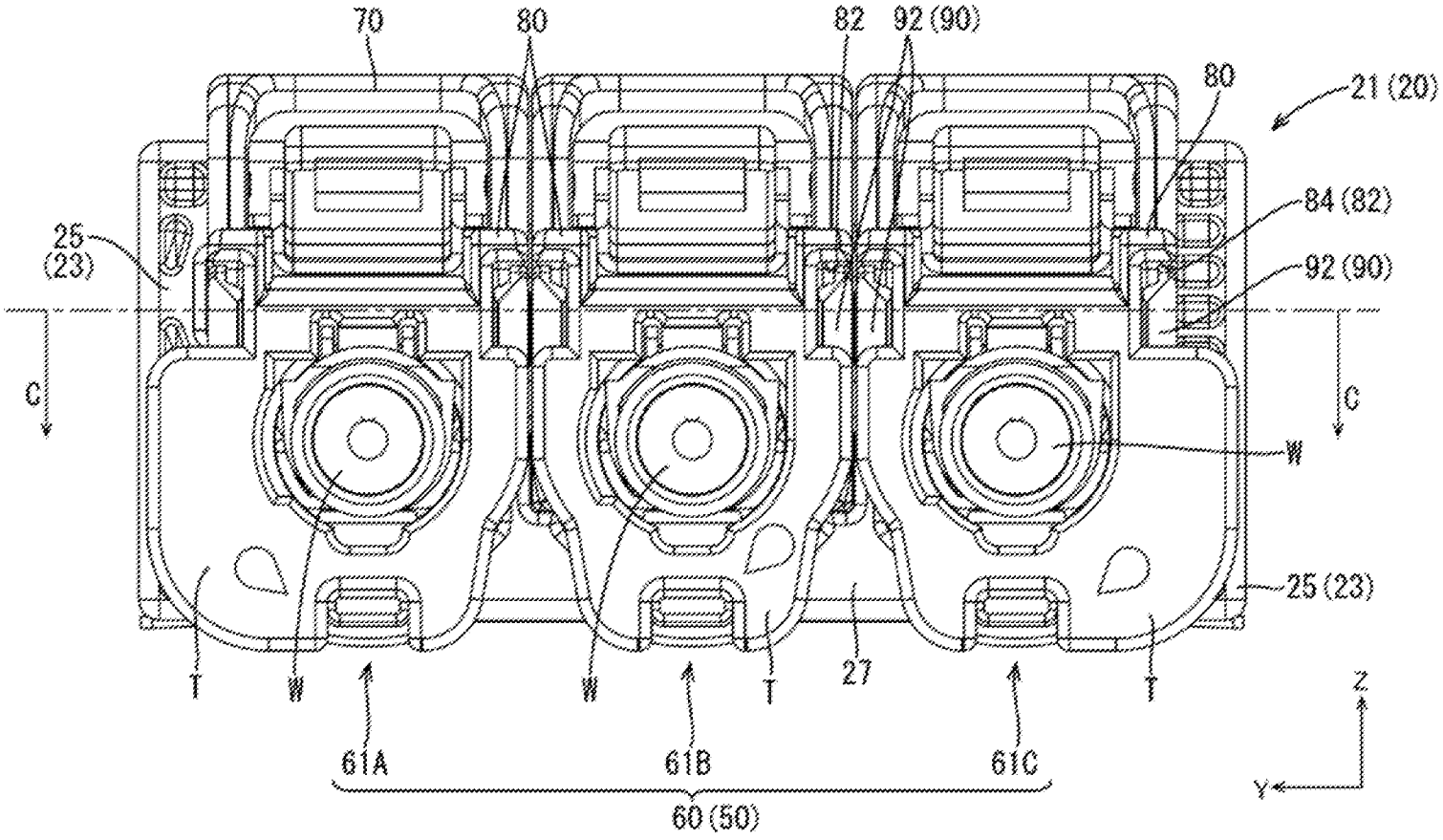
FIG. 10 is a back view showing a connected state of the wire-side connector set and the board connector.

Accordingly, if the fittings 72 of the connectors 61 are fit side by side in the lateral direction in the accommodating portions 22 of the board connector 20, the right locked piece 92 in the retainer 90 of the first connector 61A and the left locked piece 92 of the second connector 61B are adjacent in the lateral direction, as shown in FIGS. 9 and 10. Further, the left locked piece 92 of the third connector 61C and the right locked piece 92 of the second connector 61B are adjacent in the lateral direction. Further, two locked pieces 92 adjacent in the lateral direction are aligned in the front-rear direction with the separation wall 27 of the accommodating portion 22, as shown in FIG. 11.

That is, the two locked pieces 92 adjacent in the lateral direction are arranged at a position that originally is a dead space formed in front of the separation wall 27 between the adjacent connectors 61.

Figure 11:
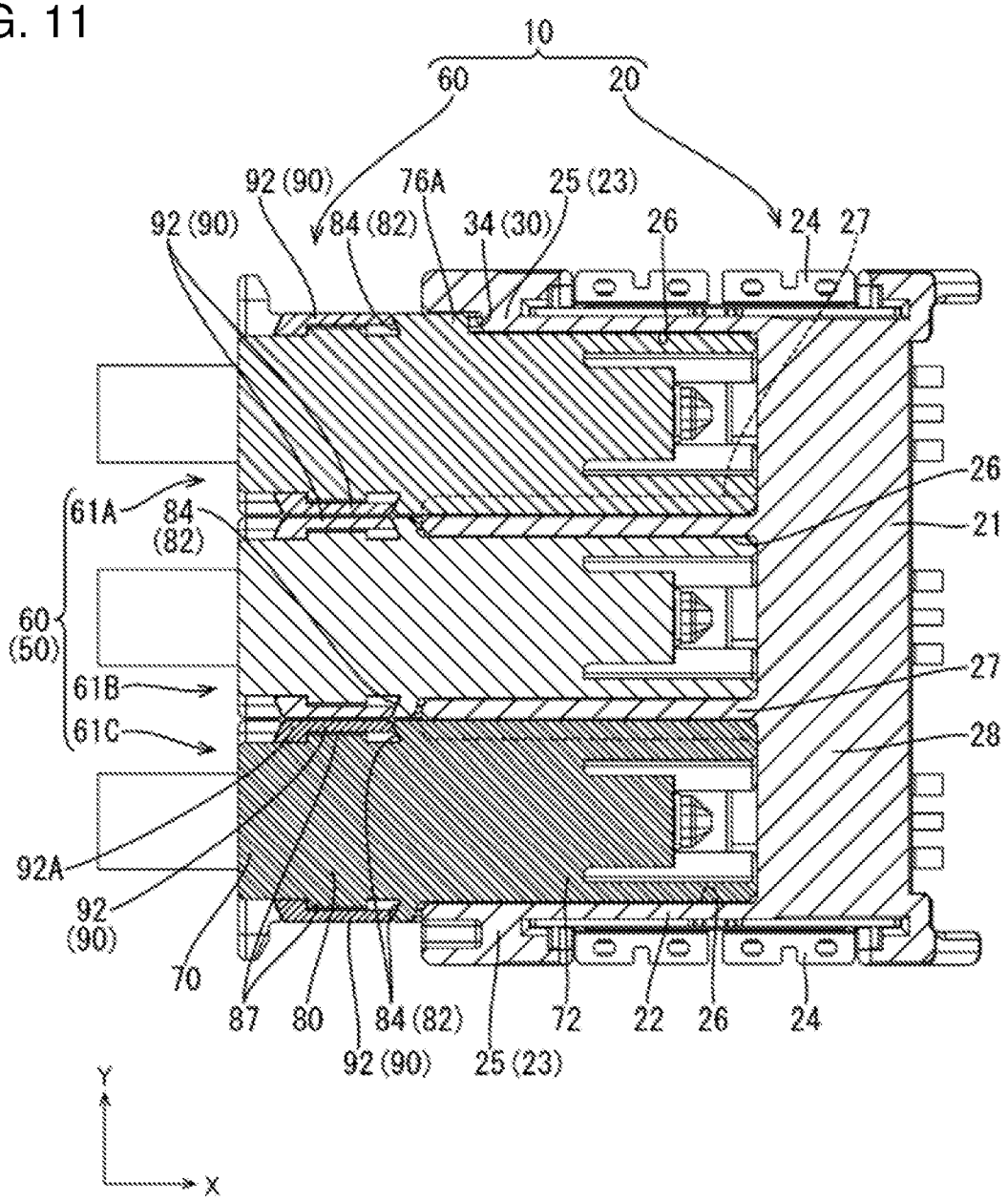
FIG. 11 is a section along C-C of FIG. 10.

Further, as shown in FIG. 11, the left locked piece 92 of the first connector 61A is aligned in the front-rear direction with the side wall 25 of the accommodating portion 22 and the right locked piece 92 of the third connector 61C is aligned in the front-rear direction with the side wall 25 of the accommodating portion 22.

That is, one locked piece 92 of each of the first and third connectors 61A, 61C is arranged at a position that originally was a dead space formed in front of the side wall 25, on the lateral side of the first or third connector 61A, 61C.

An interval between the two adjacent locked pieces 92 is smaller than a resilient displacement amount of the locked piece 92 when the locked projection 93 rides over the partial locking portion 86 and the full locking portion 87. That is, with the three connectors 61 and the board connector 20 connected, the retainers 90 are not easily detached from the wire-side housings 70.

Next, the multi-pole wire-side connector 100 is described with reference to FIGS. 12 to 16.

[Multi-Pole Wire-Side Connector 100]

Figure 12:
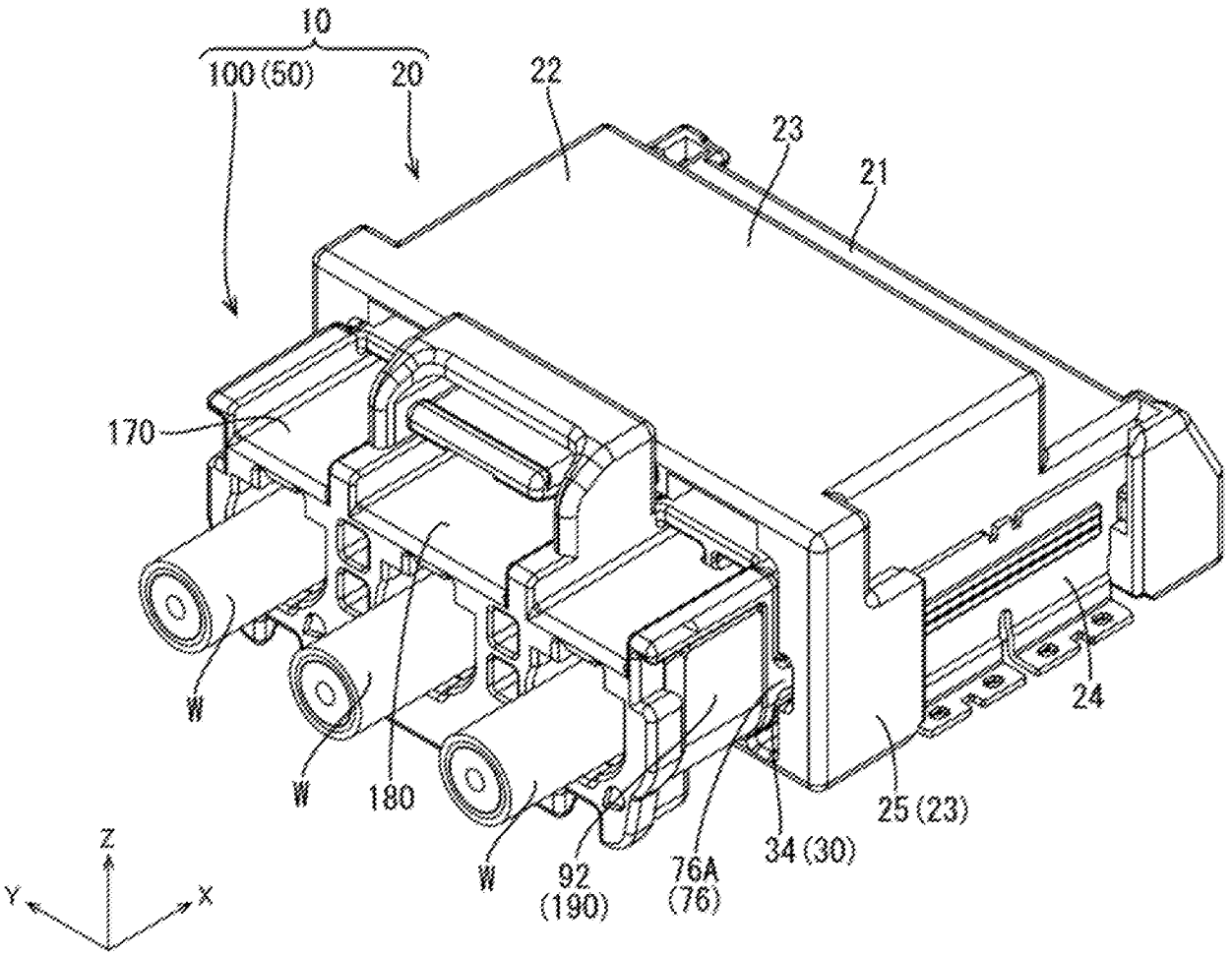
FIG. 12 is a perspective view showing a connected state of a multi-pole wire-side connector and the board connector.
Figure 13:
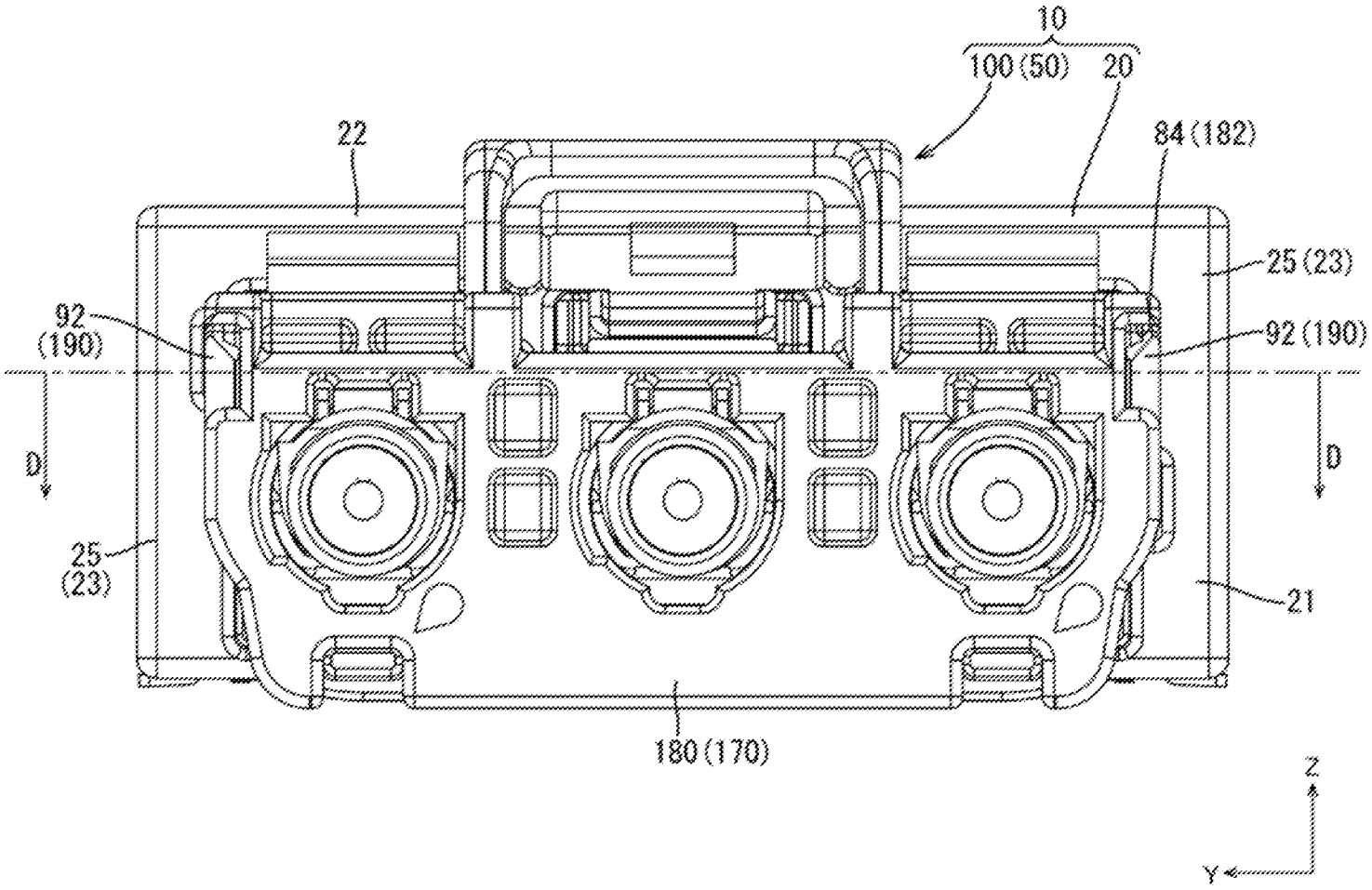
FIG. 13 is a back view showing the connected state of the multi-pole wire-side connector and the board connector.

As shown in FIGS. 12 and 13, the multi-pole wire-side connector 100 is connected to ends of a plurality of shielded cables W and long in the lateral direction. The multi-pole wire-side connector 100 in this embodiment is connected to ends of three shielded cables W.

The multi-pole wire-side connector 100 includes wire-side inner conductors 62 and wire-side outer conductors 65 to be connected to the ends of the plurality of respective shielded cables W, dielectrics 64 arranged between the wire-side inner conductors 62 and the wire-side outer conductors 65, a multi-pole housing (an example of a "housing") 170 for accommodating the plurality of wire-side outer conductors 65 and a large-size retainer (an example of a "retainer") 190 to be assembled with the multi-pole housing 170. Note that the wire-side inner conductors 62, the wire-side outer conductors 65, the dielectrics 64 and the shielded cables W have configurations common to those of the first connector 61A and, hence, are denoted by the same reference signs and not described.

[Multi-Pole Housing 170]

Figure 14:
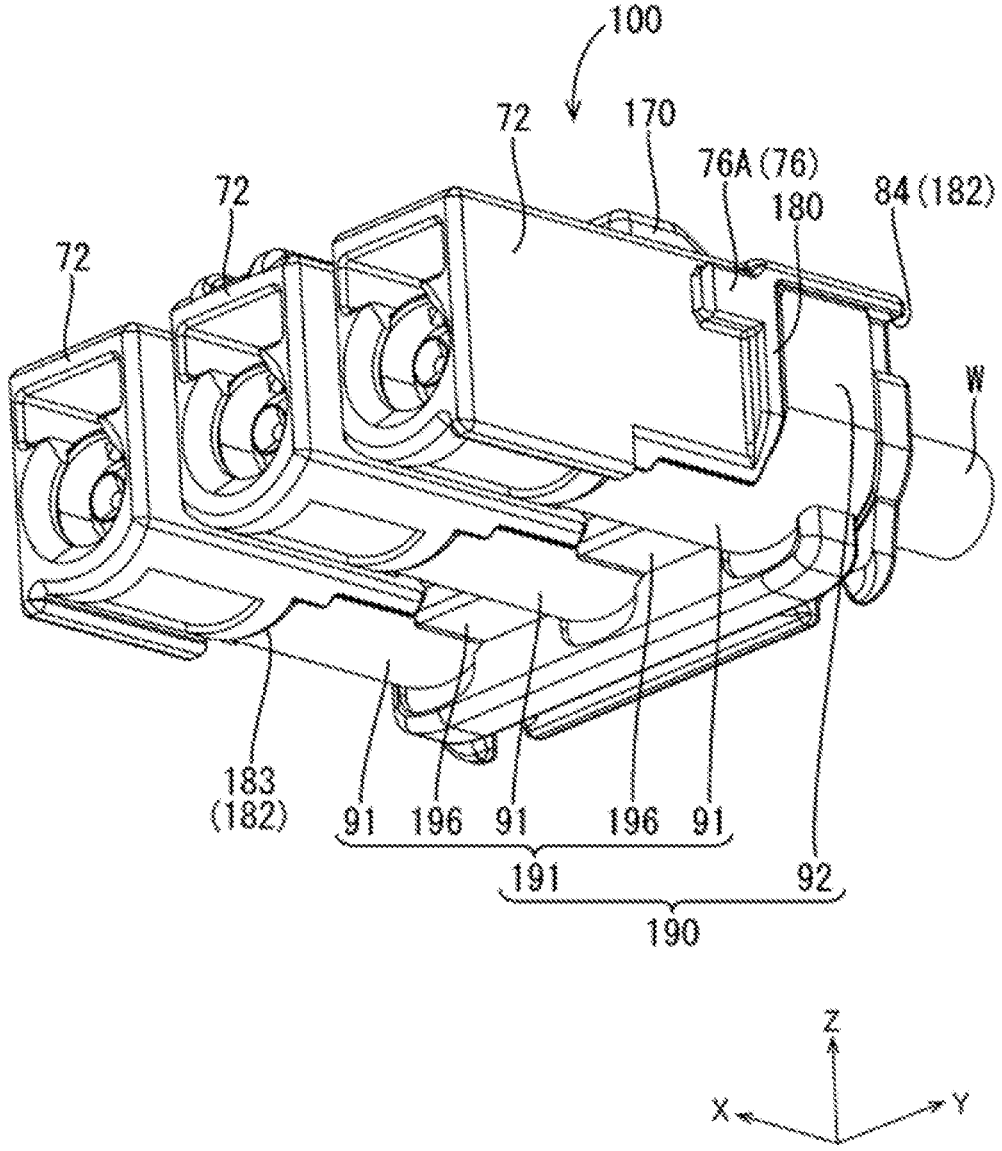
FIG. 14 is a perspective view of the multi-pole wire-side connector.

The multi-pole housing 170 is made of insulating synthetic resin. The multi-pole housing 170 includes, as shown in FIG. 14, a plurality of fittings 72 to be fit collectively into the accommodating portion 22 of the board connector 20 and a large exposed portion 180 connected to the rear ends of the plurality of fitting portions 72. In the multi-pole housing 170 of this embodiment, the large exposed portion 180 is connected to the rear ends of three fittings 72.

The left fitting 72 has a configuration common to the fitting 72 of the first connector 61A and the middle fitting 72 has a configuration common to the fitting 72 of the second connector 61B. Further, the right fitting 72 has a configuration common to the fitting portion 72 of the third connector 61C. Thus, the description of the fitting portions 72 is omitted.

Figure 15:
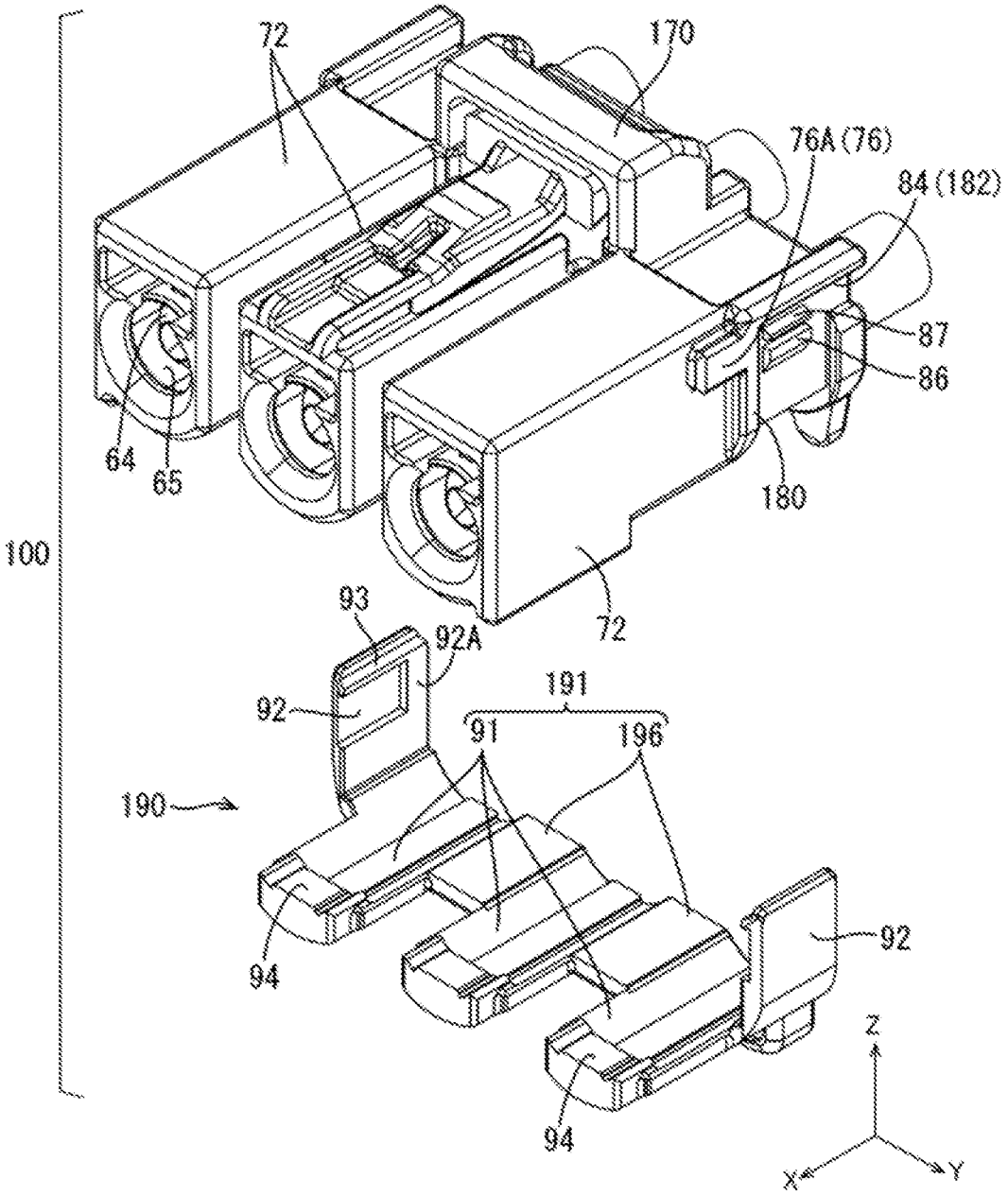
FIG. 15 is a perspective view showing a state before a large-size retainer is assembled with a multi-pole housing.

As shown in FIGS. 14 and 15, the large exposed portion 180 is a rectangular tube that is wider than a range where three fittings 72 are arranged. The large exposed portion 180 projects from the accommodating portion 22 to be exposed as shown in FIG. 12 when the three fittings 72 are fit into the respective cavities 26.

As shown in FIG. 14, the multi-pole housing 170 is formed with a large mounting recess 182 provided over the three fitting portions 72 and the large exposed portion 180.

The large mounting recess 182 includes a first large mounting recess 183 concavely formed over a lower end part of each fitting 72 and a lower end part of the large exposed portion 180 and second mounting recesses 84 concavely formed in both lateral side parts of the large exposed portion 180. The second mounting recesses 84 have a configuration common to the second mounting recesses 84 of the connectors 61 and are not described.

The first large mounting recess 183 extends in the front-rear direction in the lower parts of the respective fittings 72 and extends in the lateral direction in the lower end part of the large exposed portion 180.

A mounting hole 72A communicating with an outer conductor accommodating portion 74 of the fitting 72 is formed at a front position of each part of the first large mounting recess 183 corresponding to the fitting 72, similarly to the mounting hole 72A of the embodiment shown in FIG. 7.

[Large Retainer 190]

As shown in FIG. 15, the large retainer 190 is made of insulating synthetic resin separately from the multi-pole housing 170.

The large retainer 190 is mountable into the large mounting recess 182 of the multi-pole housing 170 from below. The large retainer 190 includes a large body 191 to be mounted into the first large mounting recess 183 and two locked pieces 92 to be mounted into the second mounting recesses 84. The locked pieces 92 have configurations common to the locked pieces 92 in the retainer 90 and are not described again.

The large body 191 includes three locking portion bodies 191 corresponding to the respective fittings 72 and two couplings 196 coupling adjacent ones of the locking portion bodies 91 in the lateral direction. The locking portion bodies 91 have configurations common to the locking portion body 91 in the retainer 90 and are not described again.

The large body 191 constitutes the outer surfaces of the lower end parts of the respective fittings 72 and the large exposed portion 180 as shown in FIG. 14 when the large retainer 190 is held at a full locking position to be mounted in the large mounting recess 182. Further, the locked pieces 92 constitute the left and right outer surfaces of the large exposed portion 180.

Figure 16:
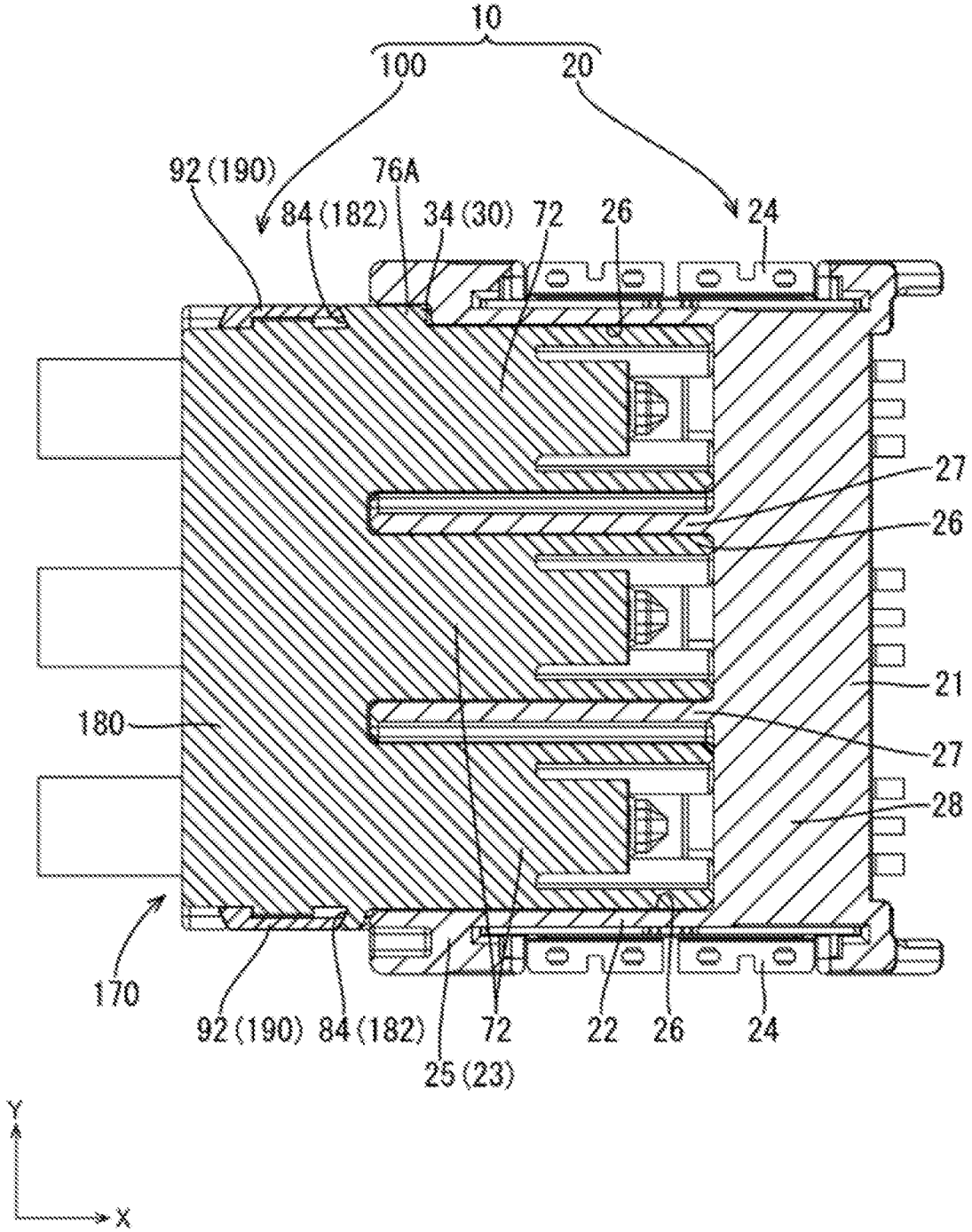
FIG. 16 is a section along D-D of FIG. 13.

Accordingly, if the three fittings 72 are fit side by side in the lateral direction into the accommodating portion 22 of the board connector 20, the locked pieces 92 are aligned in the front-rear direction with the side walls 25 of the accommodating portion 22 as shown in FIG. 16.

That is, one locked piece 92 of the large retainer 190 is at a position that originally is a dead space formed in front of the side wall 25, on the lateral side of the multi-pole wire-side connector 100.

This embodiment is configured as described. Next, functions and effects of the connector device 10 are described.

In the case of locking a retainer to a fitting in a wire-side connector including the fitting to be fit into an accommodating portion of a board connector, the fitting is enlarged if a locking margin of a locking portion of the fitting and a locked portion of the retainer is secured. If the fitting is enlarged, the board connector into which the fitting is fit is also enlarged.

Accordingly, the inventors found out the configuration of this embodiment as a result of an earnest study to solve the above problem.

Specifically, this embodiment relates to the wire-side connector set 60 or multi-pole wire-side connector (connector) 100 to be connected to the board connector 20 (mating connector) and including at least one wire-side outer conductor (terminal) 65, the wire-side housing 70 or multi-pole housing (housing) 170, and the retainer 90 or large-size retainer (retainer) 190.

The wire-side housing 70 or multi-pole housing 170 includes at least one fitting 72 and the exposed portion 80 or large-size exposed portion 180, the fitting 72 is fittable into the board connector 20, the fitting 72 is formed with the outer conductor accommodating portion (terminal accommodating portion) 74 for accommodating the wire-side outer conductor 65, and the exposed portion 80 or large-size exposed portion 180 is exposed from the board connector 20 when the fitting 72 is fit into the board connector 20.

The retainer 90 or large retainer 190 includes the two locked pieces (locked portions) 92 and at least one locking protrusion 94, and the two locked pieces 92 fix the retainer 90 or large-size retainer 190 to the wire-side housing 70 or multi-pole housing 170 by being locked to the full locking portions (locking portions) 87 provided on the exposed portion 80 or large exposed portion 180. The locking protrusion 94 is assembled with the fitting 72 to project into the outer conductor accommodating portion 74 and retains the wire-side outer conductor 65 in the outer conductor accommodating portion 74 when the retainer 90 or large retainer 190 is fixed to the wire-side housing 70 or multi-pole housing 170.

The locked pieces 92 for fixing the retainer 90 or large retainer 190 to the wire-side housing 70 or multi-pole housing 170 are arranged around the exposed portion 80 or large-size exposed portion 180 deviated from a part to be fit into the board connector 20, as shown in FIGS. 9, 11 and 16. That is, the locked pieces 92 need not be assembled with the fitting 72. Additionally, the wire-side outer conductor 65 can be retained in the outer conductor accommodating portion 74 by the retainer 90 or large retainer 190 while the size of the fitting 72 is reduced.

The connector device 10 includes the wire-side connector set 60 or multi-pole wire-side connector 100 and the board connector 20. The board connector 20 includes the board housing (mating housing) 21. The board housing 21 includes the accommodating portion 22 into which the fittings 72 are fit. The accommodating portion 22 includes the walls 23 surrounding the fittings 72, and the locked pieces 92 are aligned in a connecting direction with the side walls 25 when the fittings 72 and the accommodating portion 20 are fit.

When the fittings 72 and the accommodating portion 22 are fit, the locked pieces 92 are arranged in parts that originally are dead spaces formed in front of the side walls 25 in the connecting direction.

That is, since the locked pieces 92 are arranged in the parts that are originally dead spaces, the connector device 10 is not enlarged, as compared to the case where the locked pieces are at positions that are not dead spaces.

The connectors 61 are provided, the cavities 26 into which the fittings 72 are fit side by side are arranged laterally in the accommodating portion 22, the separation walls 27 partition between adjacent ones of the fittings 72, the locked pieces 92 of adjacent ones of the wire-side housings 70 are arranged adjacent in the lateral direction, and adjacent locked pieces 92 are aligned in the connecting direction with the separation wall 27.

If the fittings 72 were inserted into the accommodating portion 22, a distance between the fittings increases and the accommodating portion would be enlarged when the fittings become slightly larger. However, according to this embodiment, the locked pieces 92 need not be assembled with the fittings 72, and the fittings 72 can be reduced in size. In this way, the distance between the fittings 72 can be reduced and the connector device 10 can be smaller.

The adjacent locked pieces 92 are arranged in the parts that are originally dead spaces in front of the separation walls 27 in the connecting direction, when the fittings 72 are fit respectively into the cavities 26. Thus, the connector device 10 is smaller and less complex than if the locked pieces are at different positions.

The fittings 72 are formed with the posture restricting portions 76 extending in the connecting direction. The separation walls 27 are formed with the concave receiving portions 30 for respectively accommodating the posture restricting portions 76 of the adjacent fittings 72, and the respective receiving portions 30 of the separation walls 27 are deviated in the vertical direction (direction intersecting the connecting direction). The receiving portions 30 and the posture restricting portions 76 are locked in the vertical direction to restrict the posture inclination of the fittings 72 in the vertical direction.

The receiving portions 30 for accommodating the posture restricting portions 76 are formed concavely in the separation walls 27 while being deviated in the vertical direction. In this way, the distance between the fittings 72 can be reduced, for example, as compared to the case where receiving portions in separation walls are arranged side by side in the lateral direction or project. That is, the connector device 10 can be reduced in size.

Other Embodiments

Although the accommodating portion 22 is formed with three cavities 26 in the above embodiment, there is no limitation to this. Two, four or more cavities may be formed in an accommodating portion.

Although the mating connector to be connected to the connector group 50 is the board connector 20 in the above embodiment, there is no limitation to this. The mating connector to be connected to the connector group 50 may be a connector to be connected to ends of wires.

Although the connectors 61 or multi-pole wire-side connector 100 including the wire-side inner conductors 62, the dielectrics 64 and the wire-side outer conductor 65 and configured such that the wire-side outer conductors 65 are retained by the retainer 90 or large-size retainer 190 are/is illustrated in the above embodiment, there is no limitation to this. The disclosure may be applied to a connector including female or male terminals and configured such that the female or male terminals are retained by a retainer.

LIST OF REFERENCE SIGNS

10: connector device
20: board connector (example of "mating connector")
21: board housing (example of "mating housing")
22: accommodating portion
23: wall
24: mounting portion
25: side wall
26: cavity
27: separation wall
28: back wall
30: receiving portion
30U: inclined surface
32: long receiving portion
34: short receiving portion
36: board-side inner conductor
37: male connecting portion
38: board-side outer conductor
39: board-side tube
50: connector group
60: wire-side connector set
61: connector (example of "connector")
61A: first connector
61B: second connector
61C: third connector
62: wire-side inner conductor
63: inner conductor accommodating portion
64: dielectric
65: wire-side outer conductor (example of "terminal")
66: connecting tube portion
67: projecting portion
68: crimping portion
70: wire-side housing (example of "housing")
72: fitting
72A: mounting hole
74: outer conductor accommodating portion (example of "terminal accommodating portion")
75: locking lance
76: posture restricting portion
76A: short restricting portion
76B: long restricting portion
80: exposed portion
82: mounting recess
83: first mounting recess
84: second mounting recess
86: partial locking portion
87: full locking portion (example of "lock")
90: retainer
91: locking portion body

92: locked piece (example of "locked portion")
92A: reinforcing portion
93: locked projection
94: locking protrusion
100: multi-pole wire-side connector (example of "connector")
170: multi-pole housing (example of "housing")
180: large exposed portion
182: large mounting recess
183: first large mounting recess
190: large retainer (example of "retainer")
191: large body
196: coupling
S: clearance
T: finger placing portion
W1: core
W2: inner coating
W3: braided wire
W4: outer coating
W: shielded cable

What is claimed is:

1. A connector to be connected to a mating connector, comprising at least one terminal, a housing and a retainer, wherein:

the housing includes at least one fitting and an exposed portion, the fitting is fit into the mating connector, the fitting is formed with a terminal accommodating portion for accommodating the terminal, the exposed portion is exposed from the mating connector when the fitting is fit into the mating connector, the retainer includes a locked portion, the locked portion is assembled with the exposed portion and locked to a lock provided on the exposed portion, thereby fixing the retainer to the housing, and the locking protrusion is assembled with the fitting to project into the terminal accommodating portion and retains the terminal in the terminal accommodating portion when the retainer is fixed to the housing.

2. A connector device, comprising at least one connector of claim 1 and the mating connector, wherein:

the mating connector includes a mating housing, the mating housing includes an accommodating portion into which the fitting portion is fit, the accommodating portion includes walls for surrounding the fitting, and the locked portion is aligned in a connecting direction with one of the walls when the fitting and the accommodating portion are fit together.

3. The connector device of claim 2, wherein:

a plurality of the connectors are provided, cavities are formed laterally side by side in the accommodating portion and a plurality of the fittings are fit respectively into the cavities, separation walls partitioning between adjacent ones of the fittings, the locked portions of adjacent ones of the housings are arranged adjacent in a lateral direction, and adjacent ones of the locked portions are aligned in the connecting direction with a respective one of the separation walls.

4. The connector device of claim 3, wherein:

the fitting is formed with a projecting posture restricting portion extending in the connector device, each of the separation walls is formed with concave receiving portions for respectively accommodating the posture restricting portions of the adjacent fittings, and the receiving portions in the respective separation wall are deviated in a direction intersecting the connecting direction.

* * * * *